US009347720B2

(12) United States Patent
Fitzpatrick et al.

(10) Patent No.: US 9,347,720 B2
(45) Date of Patent: May 24, 2016

(54) AMMUNITION MAGAZINE

(71) Applicant: Magpul Industries Corp., Boulder, CO (US)

(72) Inventors: Richard M. Fitzpatrick, Longmont, CO (US); Michael T. Mayberry, Denver, CO (US); Brian L. Nakayama, Arvada, CO (US)

(73) Assignee: MAGPUL INDUSTRIES, CORP., Louisville, CO (US)

( * ) Notice: Subject to any disclaimer, the term of this patent is extended or adjusted under 35 U.S.C. 154(b) by 0 days.

(21) Appl. No.: 13/744,224

(22) Filed: Jan. 17, 2013

(65) Prior Publication Data

US 2013/0180146 A1 Jul. 18, 2013

Related U.S. Application Data

(60) Provisional application No. 61/587,604, filed on Jan. 17, 2012.

(51) Int. Cl.
*F41A 9/70* (2006.01)
*F41A 9/65* (2006.01)

(52) U.S. Cl.
CPC .... *F41A 9/70* (2013.01); *F41A 9/65* (2013.01)

(58) Field of Classification Search
CPC ..... F41A 9/65; F41A 9/66; F41A 9/70
USPC ..... 42/17, 18, 6, 7, 21, 22, 49.01, 50; 124/45, 51.1
See application file for complete search history.

(56) References Cited

U.S. PATENT DOCUMENTS

D35,425 S * 12/1901 Johnson ..... D22/108
3,226,869 A * 1/1966 Musgrave ..... F41A 9/69 42/50

(Continued)

FOREIGN PATENT DOCUMENTS

CN 200944016 Y 9/2007
DE 8606162 4/1986

(Continued)

OTHER PUBLICATIONS

NPL; Jun. 3, 2011. http://www.thetruthaboutguns.com/2011/06/fog-horn/gear-review-lancer-l5-advanced-warfighter-magazines/.*

(Continued)

*Primary Examiner* — Samir Abdosh
*Assistant Examiner* — John D Cooper
(74) *Attorney, Agent, or Firm* — Neugeboren O'Dowd PC

(57) ABSTRACT

A new interface for a magazine follower and floor plate is used to provide greater stability to the round stack and a more sturdy system overall. The floor plate is designed with two opposite legs, the rear being shorter than the front leg so as to facilitate travel throughout the magazine and clearing of accumulated dirt and debris. The floor plate, in one embodiment, utilizes a lock plate that is shaped and sized to become a shoe for the compressed spring and associated follower. In an alternate embodiment, the floor plate itself serves the purpose and, with provided teeth, directly fastens to the magazine casing at notches manufactured in the magazine wall for that purpose. Other enhancements to the magazine include at least one matrix of divots to provide a paint surface, an over-insertion stop and a lower rear geometry to aid in clearing debris and grit.

1 Claim, 12 Drawing Sheets

(56) References Cited

U.S. PATENT DOCUMENTS

| | | | | |
|---|---|---|---|---|
| D297,854 | S * | 9/1988 | Vyprachticky | D22/108 |
| 4,888,899 | A | 12/1989 | Chesnut et al. | |
| 8,234,810 | B2 * | 8/2012 | Lee, III | F41A 9/67 42/11 |
| D688,766 | S * | 8/2013 | Fitzpatrick | D22/108 |
| 2005/0183310 | A1 | 8/2005 | Finn | |
| 2010/0126053 | A1 | 5/2010 | Fitzpatrick et al. | |
| 2010/0162604 | A1 * | 7/2010 | Dubois | F41A 21/482 42/18 |
| 2010/0251590 | A1 | 10/2010 | Fitzpatrick et al. | |
| 2010/0313458 | A1 * | 12/2010 | Aalto | F41A 9/70 42/50 |
| 2011/0005113 | A1 | 1/2011 | Fitzpatrick et al. | |
| 2011/0094137 | A1 * | 4/2011 | Fluhr | F41A 9/65 42/50 |
| 2011/0167695 | A1 * | 7/2011 | Faifer | F41A 9/67 42/50 |
| 2011/0302816 | A1 | 12/2011 | Fitzpatrick et al. | |
| 2012/0073429 | A1 * | 3/2012 | Bowles | F41A 9/68 89/138 |
| 2013/0042514 | A1 * | 2/2013 | Douglas | F41A 9/65 42/50 |

FOREIGN PATENT DOCUMENTS

| | | | |
|---|---|---|---|
| EP | 2805123 | A2 | 11/2014 |
| JP | 2015507733 | | 3/2015 |
| WO | 2013109792 | | 7/2013 |

OTHER PUBLICATIONS

Wikipedia, "Dot Matrix Printing", Webpage found at https://en.wikipedia.org/wiki/Dot_matrix_printing Inventor(s) aware of prior art on or before Jul. 16, 2015, p. 9.

ingunowners.com, "Marking your Magazines?", Webpage found at http://ingunowners.com/forums/accessories-gear/95433-marking-your-magazines.html Inventor(s) aware of prior art on or before Jul. 16, 2015, p. 4.

ingunowners.com, "Pen for Marking Magazines", Webpage found at http://ingunowners.com/forums/general-firearms-discussion/237593-pen-marking-magazines.html Inventor(s) aware of prior art on or before Jul. 16, 2015, p. 5.

Renan Menier, "Partial Search Report of EP 13738364", Oct. 28, 2015, p. 1 Published in: EP.

"International Search Report and Written Opinion of PCT/US13/21996", Mar. 28, 2013, p. 8 Published in: WIPO.

Cuthbert, Barry, "New Zealand Examination Report", Feb. 23, 2015, p. 2, Published in: NZ.

Chenming, Wu, "Chinese Office Action re Application No. 2013800056975", Jul. 12, 2015, p. 18, Published in: CN.

Tokai Law Firm, "English Translation of Japanese Office Action Issued Aug. 19, 2015 for Japanese Application No. 2014-553418", Aug. 19, 2015, p. 4, Published in: JP.

Ong, Jennie, "Singapore Office Action re Application No. 11201404050W", Mar. 11, 2015, p. 6, Published in: SP.

Poh, Daniel, "Response to Singapore Office Action re Application No. 11201404050W", Oct. 2, 2015, p. 12, Published in: SP.

* cited by examiner

AMMUNITION MAGAZINE

CROSS-REFERENCES TO RELATED APPLICATIONS

This application claims priority as a perfection of prior filed U.S. provisional application No. 61/587,604, filed Jan. 17, 2012 and incorporates the same by reference herein in its entirety.

FIELD OF THE INVENTION

The present invention relates to the field of firearms and more particularly relates to an improved ammunition magazine.

BACKGROUND OF THE INVENTION

Ammunition magazines are well known in the art of firearms. Their basic construction is a containment shell with two open ends. One end is deemed the "floor" of the magazine and is covered by a plate while the opposite end is the "feed" end and interfaces with the weapon. Inside the volume defined by the shell and plate is a spring and follower assembly. When ammunition is loaded into the magazine, the ammunition pushes the follower down towards the floor and thereby compresses the spring. In use, when one cartridge of ammunition is expended, the compressed spring releases and pushes the follower and associated ammunition upwards toward the feed end and the next round of ammunition is thereby readied.

Prior magazines have been manufactured in many different configurations and of different materials. Perhaps the best known in the U.S. are the AK-47 and the USGI AR15/M16 magazines. These magazines function similarly, though they are made with slight variations to interface with their host system. Of notable difference is that the AK-47 magazine has a relatively constant curvature while the AR15/M16 magazine has a less curved lower region that gradually resolves to a more linear function towards the feed end. Both use the same type of internal system. Of particular note with both systems, and all follower magazine systems, is that the system works well only as the follower smoothly and levelly travels the inside of the magazine. As the follower must move, there is room for the follower in all the known prior art magazines to move axially, or "wobble," and possibly jam. This is notorious in the AR15/M16 magazine style as the geometry of the magazine is inherently not uniform. Previous attempts to address the many issues with the AR15/M16 magazine have been made, including magazines previously invented by the applicants and disclosed in U.S. Pat. Nos. 7,908,780, issued Mar. 22, 2011, and 8,069,601, issued Dec. 6, 2011. Both of these patents and products based upon them have fared well in the market as solutions to AR15/M16 magazine issues and serve as a basis for the magazine construction disclosed herein. Accordingly, these two patents are incorporated by reference in their entirety herein.

Of particular interest in the construction of ammunition magazines is the shape of and interface between the follower and the floorplate. The interface needs to be stable when the magazine is fully loaded and, traditionally, the floorplate has been flat with the follower having some contact with the floor plate when the magazine was fully loaded. Various follower designs have been introduced in efforts to improve the performance of ammunition magazines; however, there is usually some trade-off between the motion of the follower and associated round stack and ultimate stability.

The present invention is a polymer magazine utilizing an improved floor plate and interfacing follower. The follower is constructed with fore and aft legs, the fore leg being longer. The floor plate is generally a two-piece floor plate and lock plate combination, the lock plate becoming a shoe for the follower when the magazine is fully loaded. In an alternate, slim-line, version, the lock plate is omitted and the floor plate serves as the follower's shoe.

SUMMARY OF THE INVENTION

In view of the foregoing disadvantages inherent in the known types of ammunition magazines, this invention provides an improved magazine. As such, the present invention's general purpose is to provide a new and improved magazine that is backwards compatible with known weapon platforms and presents a more stable follower and follower path.

To accomplish these objectives, the improved follower and floor plate combination provides a lock plate serving as a shoe to directly and perfectly fit and support the follower when the magazine is fully loaded. In an alternate embodiment, the floor plate is so constructed to serve the same purpose without the lock plate. The follower, in either event, is constructed in a manner to facilitate travel throughout the length of the magazine body.

The more important features of the invention have thus been outlined in order that the more detailed description that follows may be better understood and in order that the present contribution to the art may better be appreciated. Additional features of the invention will be described hereinafter and will form the subject matter of the claims that follow.

Many objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

REFERENCE NUMBERS USED IN THE SPECIFICATION

1—Magazine
2—Magazine Casing
3—Follower Spring
4—Magazine Spine
5—Paint Matrix
6—Front Magazine Notch
7—Magazine Stop
8—Rear Magazine Notch
9—Spine Groove
10—Floor Plate
12—Lock Plate
14—Lock Plate Tab
16—Lock Plate Cradle
18—Lock Plate Pillar
20—Magazine Follower
22—Follower Front Leg
24—Follower Rear Leg
30—Alternate Floor Plate
32—Alternate Cradle
34—Alternate Pillar
36—Cradle Tooth
38—Pillar Tooth

DETAILED DESCRIPTION OF THE PREFERRED EMBODIMENT

With reference now to the drawings, the preferred embodiment of the ammunition magazine is herein described. It should be noted that the articles "a", "an" and "the", as used in this specification, include plural referents unless the content clearly dictates otherwise.

Figure 1:
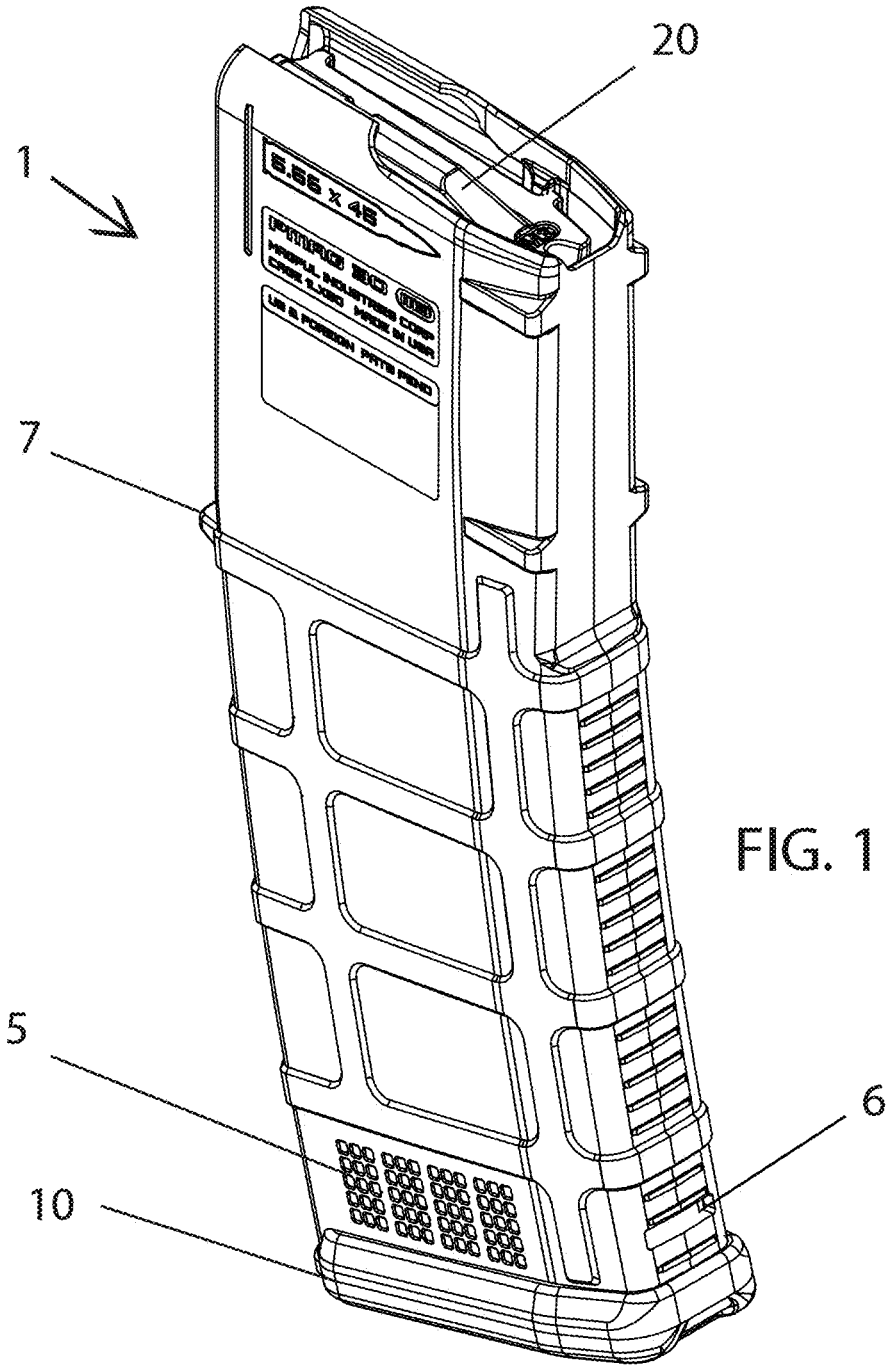
FIG. 1 is a perspective view of a magazine utilizing an embodiment of the invention.
Figure 2:
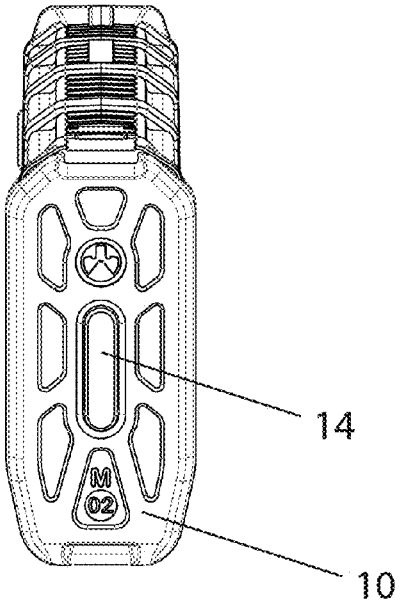
FIG. 2 bottom plan view of the magazine of FIG. 1.
Figure 3:
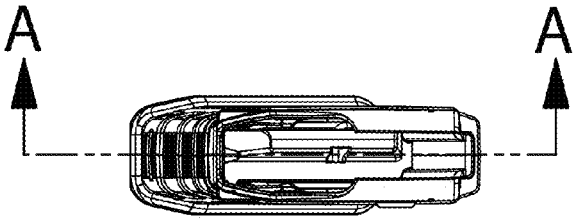
FIG. 3 is a top plan view of the magazine of FIG. 1, with its spring compressed.
Figure 4:
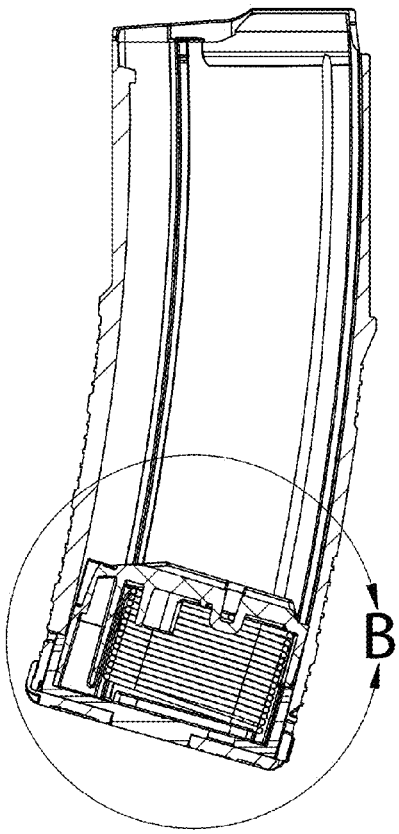
FIG. 4 is sectional view of the magazine of FIG. 3, taken along line A-A.
Figure 5:
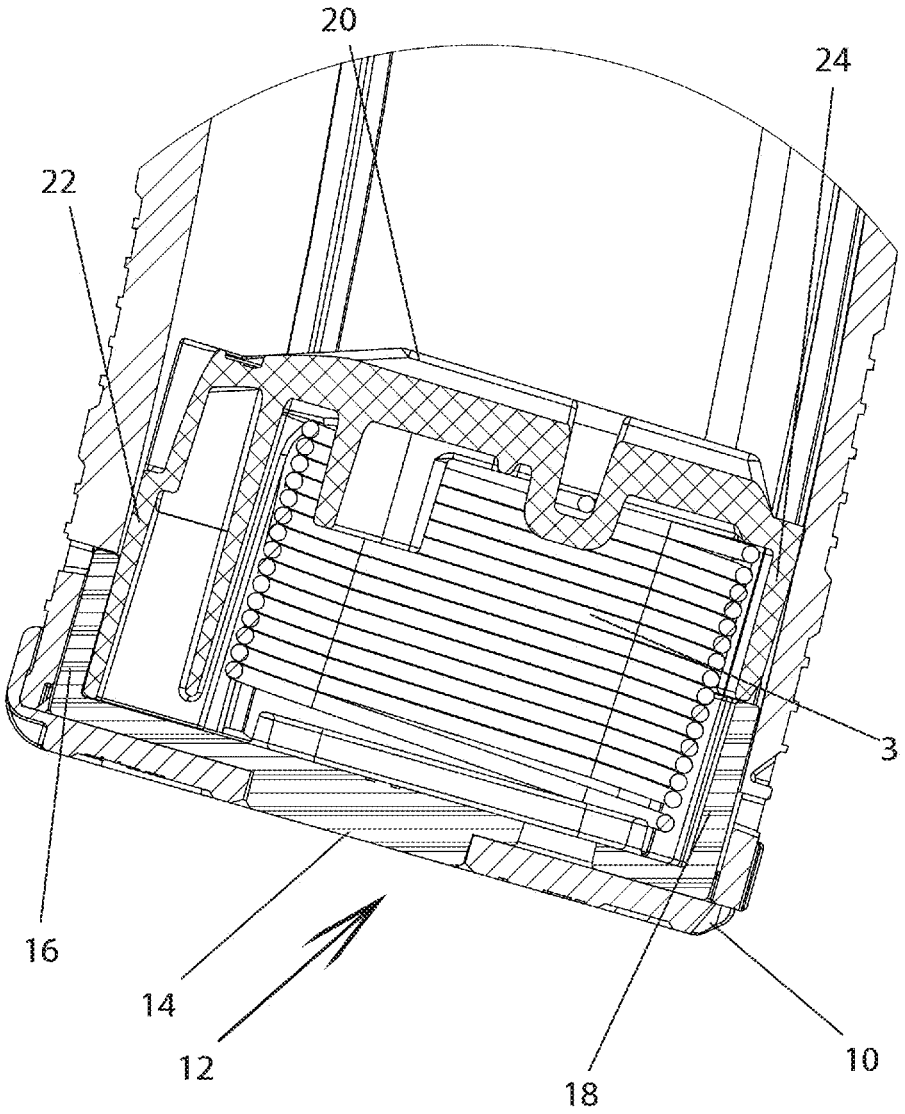
FIG. 5 is a close up view of the magazine of FIG. 4, taken in circle B.
Figure 6:
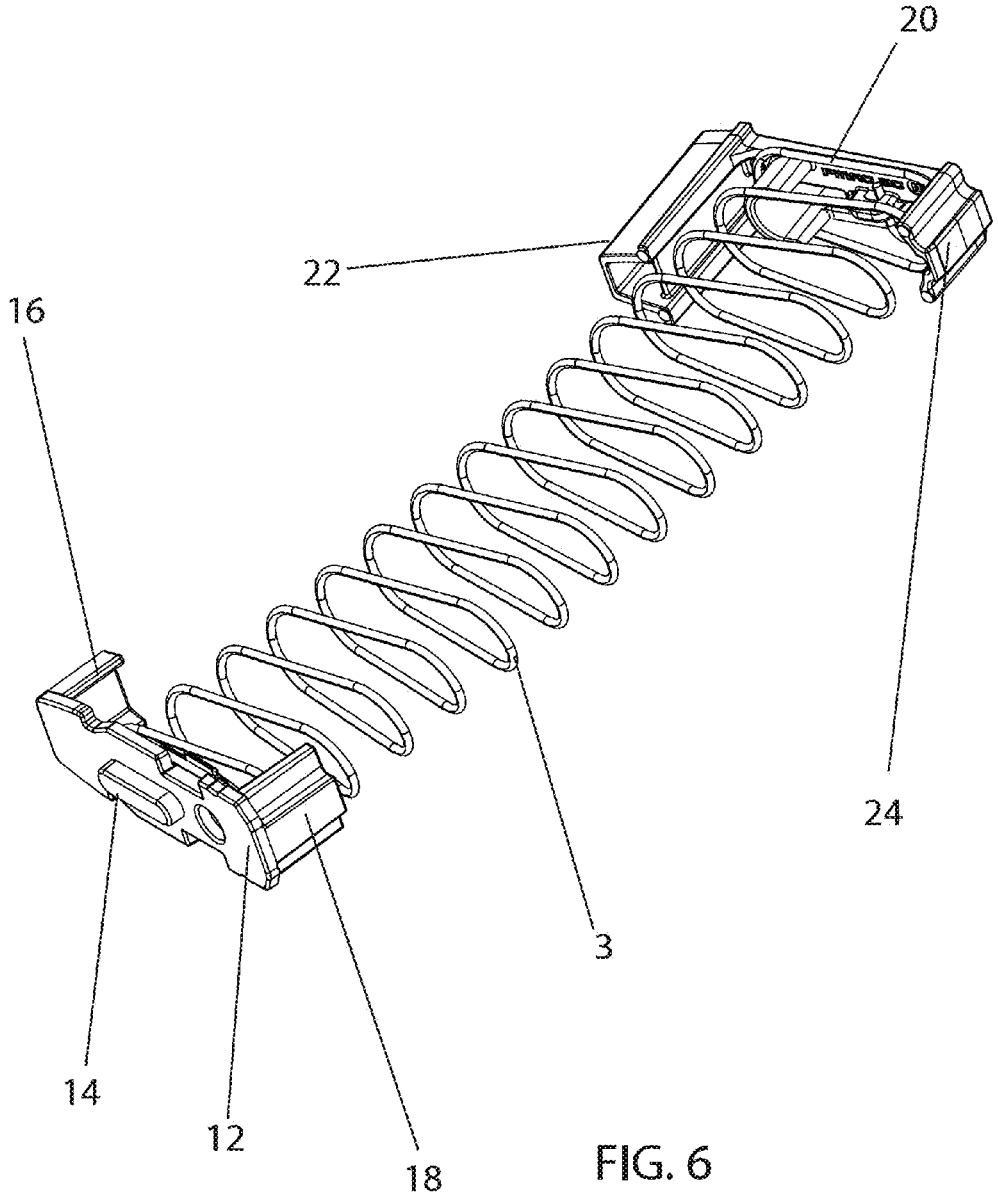
FIG. 6 is a perspective view of the follower, lock plate and spring of the magazine of FIG. 1.

With reference to FIG. 1, the magazine 1 generally comprises a generally rectangular casing, having short fore and aft sides and longer lateral sides and an open floor end and an open feed end. Feed lips are provided at the feed end to interface with a weapon and to guide cartridges into the firing chamber of said weapon. The floor end is capped with a floor plate 10. Ideally, floor plate 10 is secured by a lock plate 12 (FIG. 5). The manner in which the lock plate 12 secures the floor plate 10 is as follows: the floor plate 10 is configured to slide over a rim at the floor end of the magazine. The lock plate 12 rests against the floor plate 10 and is under pressure from the follower spring 3. A tab 14 of the lock plate 12 is positioned to pass through an orifice of the floor plate (FIG. 2). As the lock plate 12 is under pressure, the tab maintains its position and prevents the floor plate 10 from sliding off of the magazine's rim.

As shown in FIGS. 4-8, the follower 20 may be constructed with rear leg 24 shorter than the front leg 22. This construction makes the system clear dirt and grime easier than having the two legs equal in length. To compensate for the shortened leg 24, a pillar 18 is constructed on the lock plate 12 in a manner to abut the shorter rear leg 24 when the spring 3 is compressed. Together, the pillar 18 and shorter rear leg 24 should be about equal to the length of the forward leg 22. Together, these structures will prevent the spring 3 from being over-compressed and provide greater stability to the round stack and system when the spring is compressed to its maximum extent.

Another improvement is the addition of a cradle 16 at the fore end of the lock plate 12. The cradle 16 extends into the magazine body and will interface with the forward leg 22 as the spring 3 is compressed. The cradle 16 serves as a block in the instance where a large amount of force compresses the spring 3 and, in turn, pushes the lock plate 12 and floor plate 10 slightly beyond the lower rim of the magazine 1. Without the cradle 22, such circumstances may cause the lock plate 12 to slip out of alignment with the magazine casing. The cradle 22 also contributes to follower stability at the lower magazine extremity. Together, the pillar 24 and cradle 22 make the lock plate 12 a type of shoe for the spring 3 and follower 20.

Figure 7:
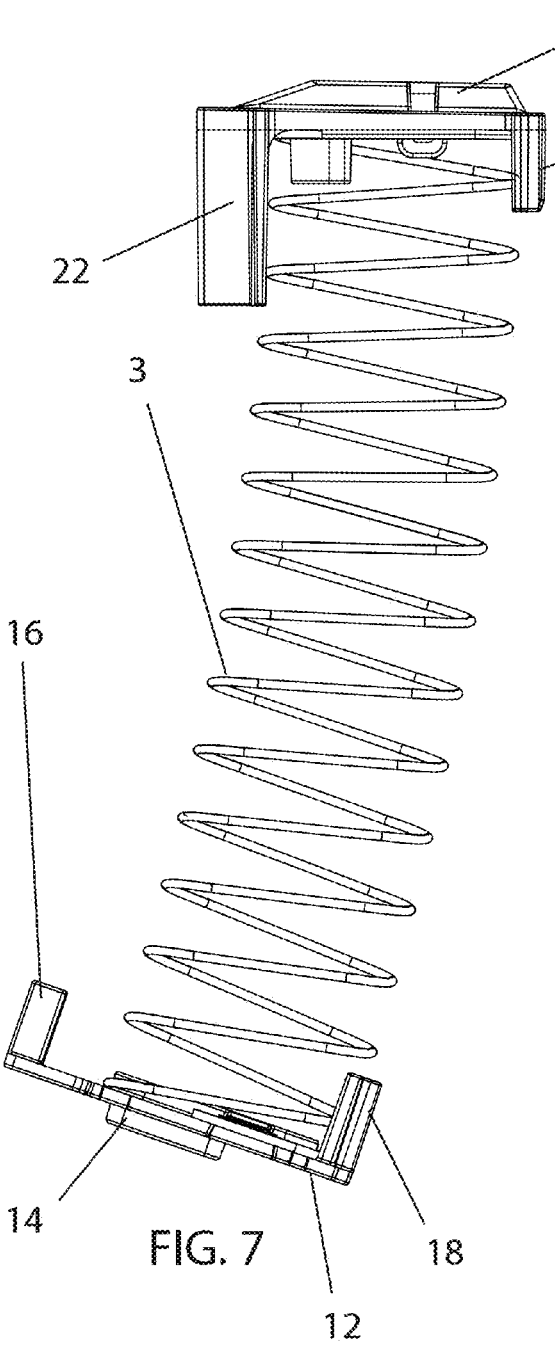
FIG. 7 is a side elevation of the follower, spring and lock plate of FIG. 6.
Figure 8:
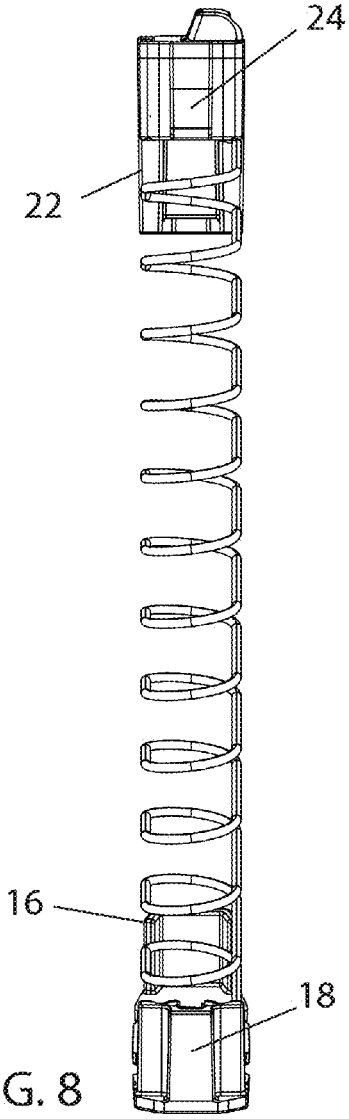
FIG. 8 is a rear elevation of the follower, spring and lock plate of FIG. 6.
Figure 9:
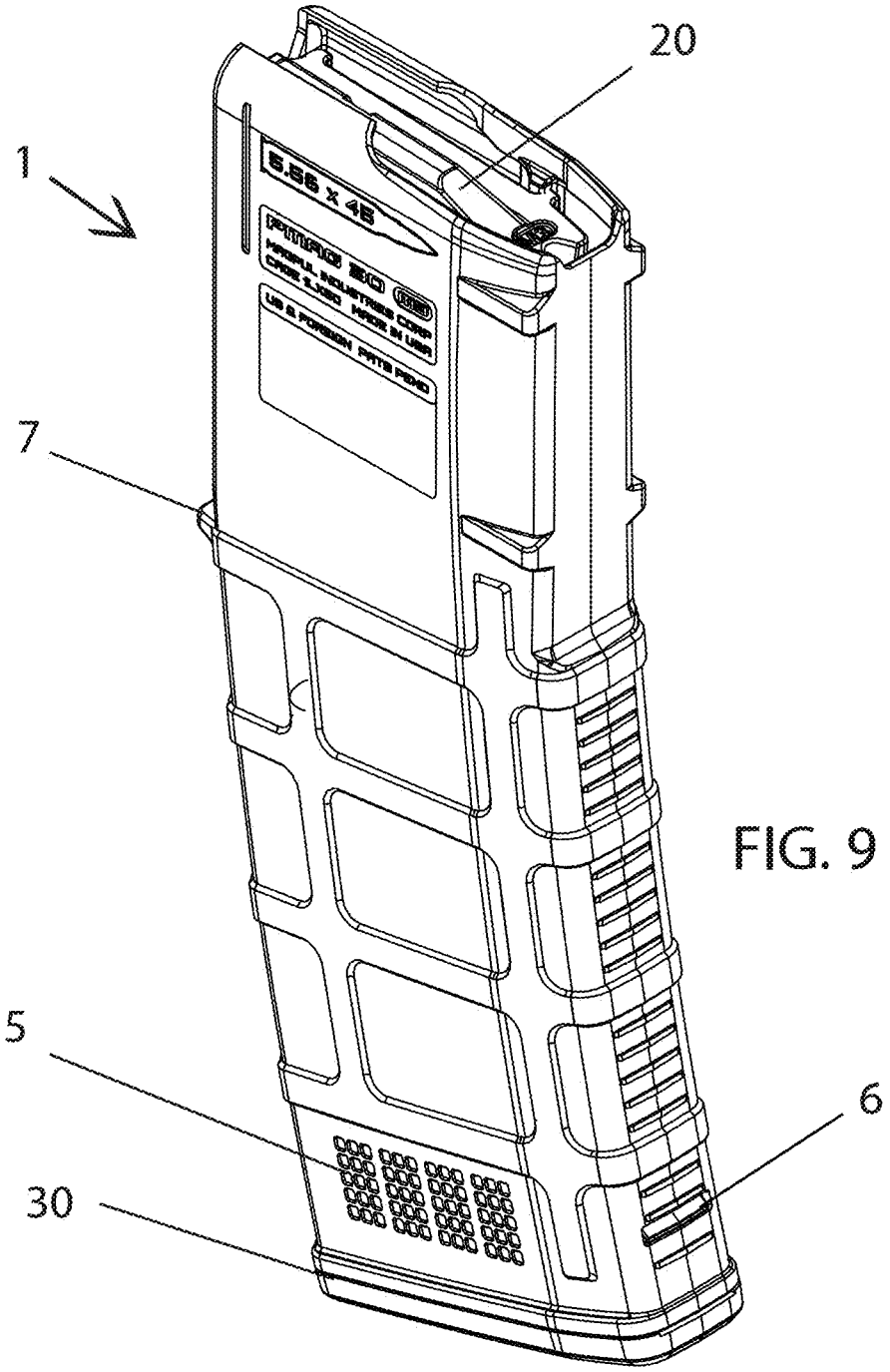
FIG. 9 is a perspective view of a magazine using an alternate embodiment of the invention
Figure 10:
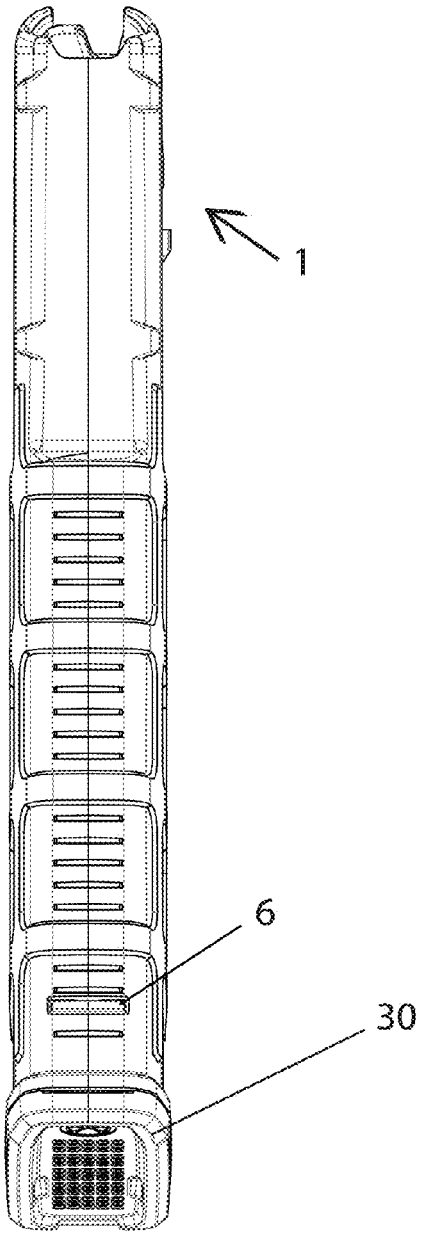
FIG. 10 is front elevation of the magazine of FIG. 9.
Figure 11:
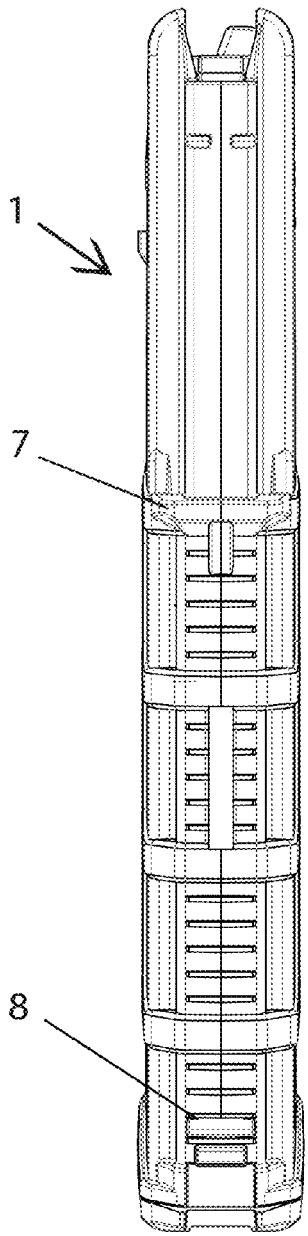
FIG. 11 is a rear elevation of the magazine of FIG. 9.
Figure 12:
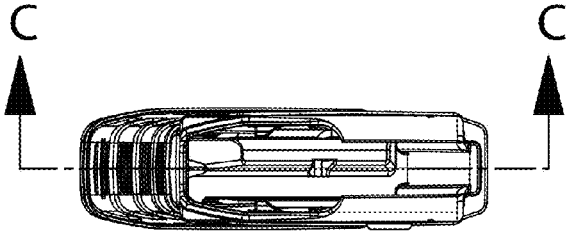
FIG. 12 is a top plan view of the magazine of FIG. 9, with its spring compressed.
Figure 13:
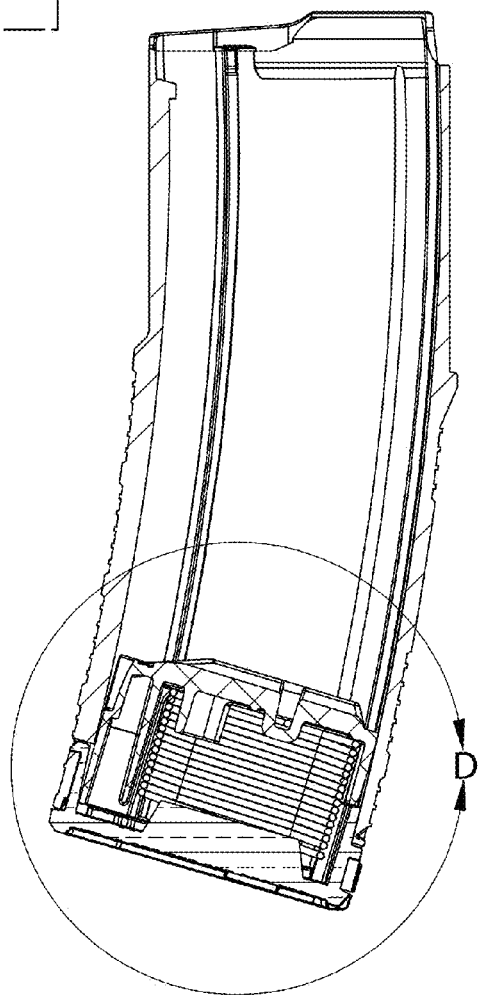
FIG. 13 is sectional view of the magazine of FIG. 12, taken along line C-C.
Figure 14:
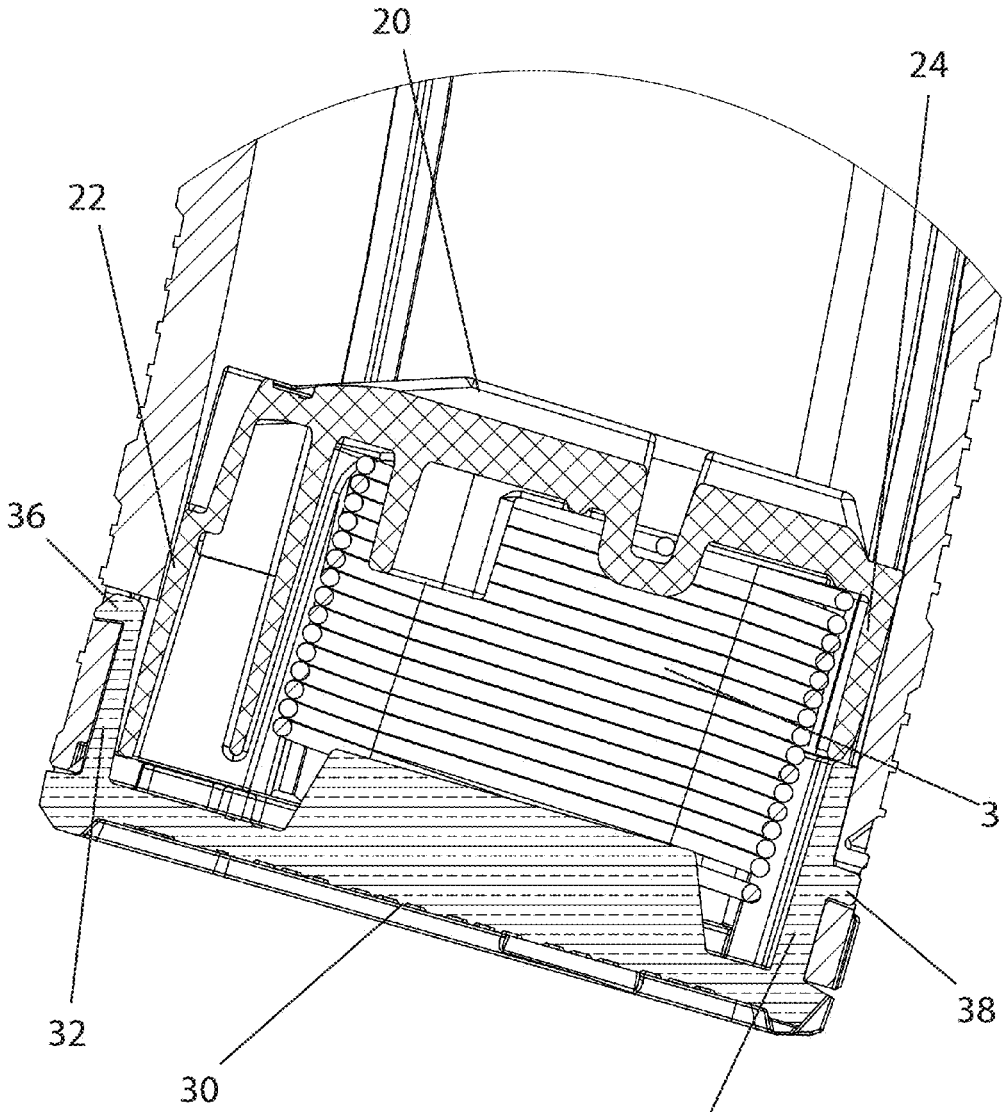
FIG. 14 is a close up view of the magazine of FIG. 13, taken in circle D.
Figure 15:
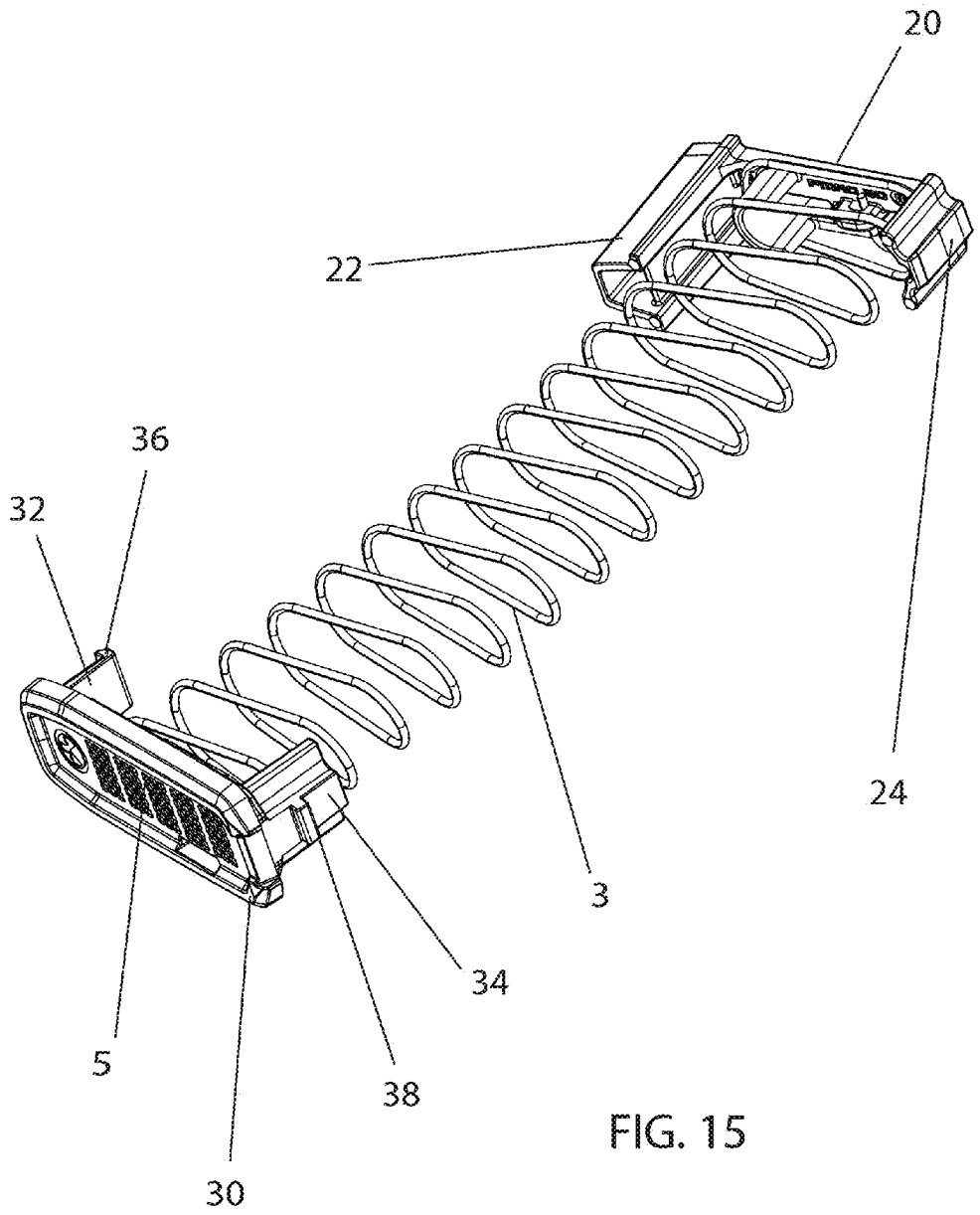
FIG. 15 is a perspective view of the follower, lock plate and spring of the magazine of FIG. 9.
Figure 16:
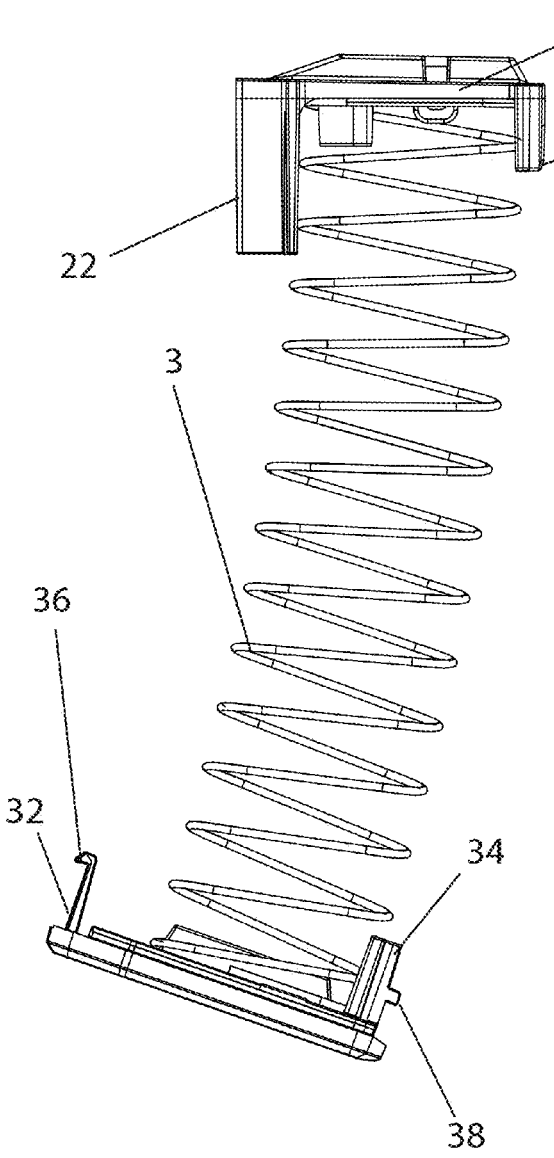
FIG. 16 is a side elevation of the follower, spring and lock plate of FIG. 15.
Figure 17:
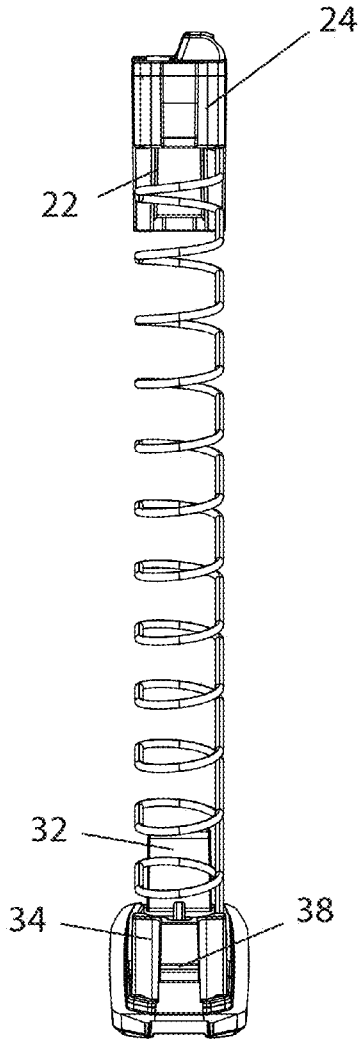
FIG. 17 is a rear elevation of the follower, spring and lock plate of FIG. 15.

FIG. 9 depicts a magazine utilizing an alternate embodiment of the invention where the floor plate 30 is a slim-line floor plate and performs functions of both the floor plate 10 and lock plate 12 of the previous embodiment. Modified floor plate 30 engages notches 6 and 8 on the front and back sides of the magazine 1 respectively, shown in FIGS. 10 and 11. Like the previous embodiment, the modified floor plate 30 becomes a shoe for the spring 3 and follower 20, as shown in FIGS. 12-14. Floor plate 30 provides a pillar 34 for the rear leg 24 of follower 20 and a narrower cradle 32 for the forward leg 22. These structures function generally in the same manner as described above. Of note, both cradle 32 and pillar 34 have teeth 36, 38 which interface with notches 6, 8 in the magazine body, thus securing the floor plate 30 to the magazine 1 (FIGS. 1 5-1 7).

Figure 18:
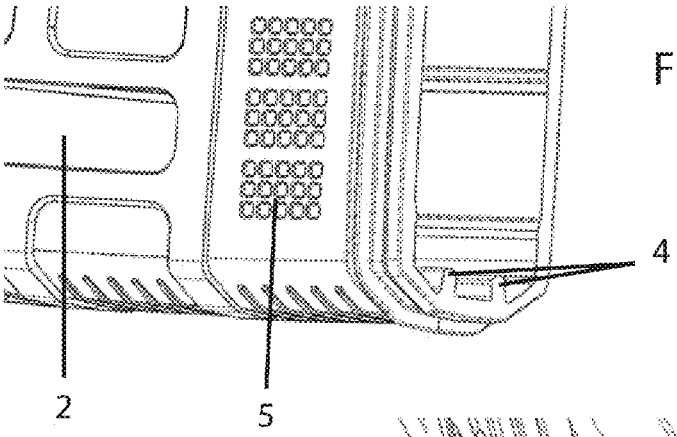
FIG. 18 is a partial lower perspective view of an alternate magazine casing.
Figure 19:
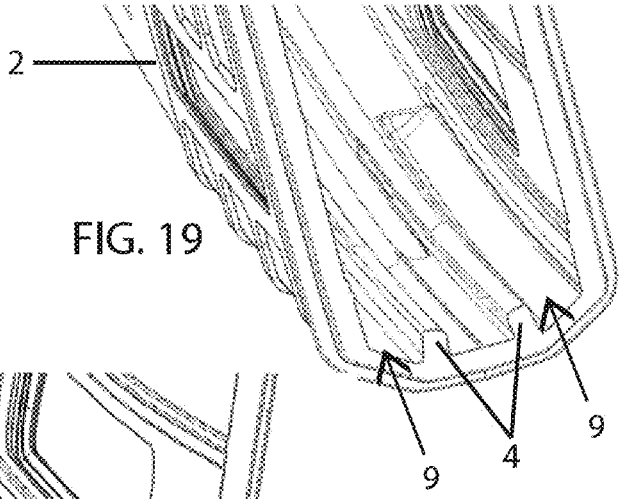
FIG. 19 is another partial lower perspective view of the magazine casing of FIG. 18.
Figure 20:
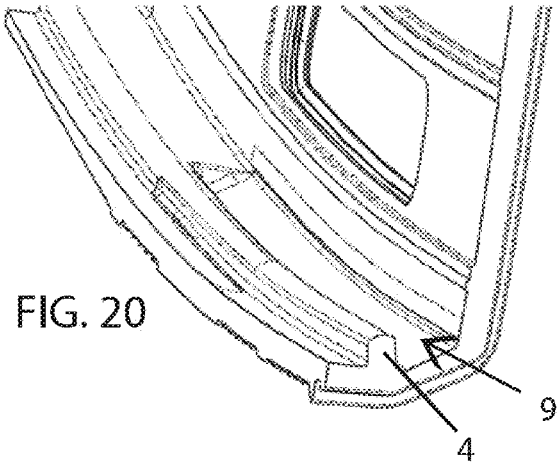
FIG. 20 is a sectional view of the casing of FIG. 19.

Another improvement to the structure of the magazine is illustrated in FIGS. 18-20 where a pair of spines 4 is built into a lower hind area of the magazine. Spines 4 are in essence a continuation of a trench in the rear of the magazine that nests the rear leg 24, as can be seen in FIG. 5. The spines 4 are essentially formed by removing material from the wall of the magazine around the trench, forming two channels 9 on either side of the spines 4 with the trench continuing therebetween. Ideally, the spines 4 and channels 9 may extend as far up the magazine as the point where the exterior geometry straightens so as to be inserted into a magazine well of a firearm, roughly as far as over-insertion stop 7 in FIG. 9. The purpose of this construction is to aid in clearance of debris and grit and to improve processing in general. As the spines 4 are, in essence, a continuation of the trench, the follower is guided by them and, if extended far enough up the magazine, the point where the channels 9 end could be used as an internal follower stop.

In all of these embodiments, the preferred magazine body is comprised of a glass-reinforced thermoplastic polymer selected to resist the heat generated from firing a rifle. However, other polymers, like polycarbonate, may be used and the magazines may be made in any color or opacity (which can reduce or eliminate the need for a magazine level indicator). Some polymers, such as polycarbonate, may be used without reinforcement. Steel, carbon fiber, and other materials may also be used to reinforce the magazine. Likewise, the magazine body may be made of other materials having suitable strength and durability, such as titanium, ceramics, laminates, amorphous metals, etc. The follower is preferred to be made of polyoxymethylene, acetal resin available commercially from DuPont under the trade name DELRIN®, though other materials are suitable, just not preferred. The magazine body may also feature improvements to aid the user in other manners (FIG. 1). At least one paint matrix 5 may be added to either the body or floor plate 30 of the magazine. Paint matrix 5 is a plurality of divots in the body of the magazine that, when painted over with some form of mark or indicia, will hold the paint mark within the cavities of the divots. An over-insertion stop 7 (FIG. 9) may also be provided so that the magazine will abut the walls of the magazine well and so prevent over-insertion of the magazine.

Although the present invention has been described with reference to preferred embodiments, numerous modifications and variations can be made and still the result will come within the scope of the invention. No limitation with respect to the specific embodiments disclosed herein is intended or should be inferred.

What is claimed is:

1. An ammunition magazine casing comprising:

a. a casing body with fore and aft sides and two longer lateral sides and first and second open ends;

b. a pair of spines located on an interior of the aft side of the body, towards the second open end, the spines defining a trench that extends at least partly toward the first open end, and the spines stopping at a point in the casing where the exterior geometry of the casing changes from substantially curved to substantially straight; and c. a pair of channels, one on either side of the spines.

* * * * *